US006637703B2

(12) United States Patent
Matheson et al.

(10) Patent No.: US 6,637,703 B2
(45) Date of Patent: Oct. 28, 2003

(54) YARD TRACKING SYSTEM

(75) Inventors: William Matheson, Palm Bay, FL (US); Russell Whitfield, Palm Bay, FL (US)

(73) Assignee: GE Harris Railway Electronics LLC, Melbourne, FL (US)

( * ) Notice: Subject to any disclaimer, the term of this patent is extended or adjusted under 35 U.S.C. 154(b) by 0 days.

(21) Appl. No.: 10/026,160

(22) Filed: Dec. 21, 2001

(65) Prior Publication Data

US 2002/0084387 A1 Jul. 4, 2002

Related U.S. Application Data

(60) Provisional application No. 60/258,520, filed on Dec. 28, 2000.

(51) Int. Cl.[7] ..... B61L 25/02

(52) U.S. Cl. ..... 246/124; 342/44; 342/51; 104/27

(58) Field of Search ..... 246/124, 122 R; 342/44, 51; 180/168, 169; 348/119; 104/27, 28, 29; 700/215

(56) References Cited

U.S. PATENT DOCUMENTS 3,470,370 A * 9/1969 Landow ..... 246/122 R
3,544,788 A * 12/1970 Guzik ..... 246/124
3,601,602 A * 8/1971 Smith ..... 246/122 R
3,611,281 A * 10/1971 Evanoff ..... 246/124
4,075,632 A * 2/1978 Baldwin et al. ..... 340/870.01
4,151,969 A 5/1979 Wood
4,329,573 A * 5/1982 Greene ..... 235/454
4,490,038 A 12/1984 Theurer et al.
4,551,725 A * 11/1985 Schaffer ..... 342/103
4,603,640 A 8/1986 Miller et al.
4,630,109 A * 12/1986 Barton ..... 348/119
4,739,328 A * 4/1988 Koelle et al. ..... 342/44
4,782,345 A * 11/1988 Landt ..... 343/700 MS
4,786,907 A * 11/1988 Koelle ..... 342/44
4,864,158 A * 9/1989 Koelle et al. ..... 327/18
4,924,402 A 5/1990 Ando et al.
5,022,174 A * 6/1991 Goff ..... 40/649
5,023,434 A 6/1991 Lanfer et al.
5,172,121 A * 12/1992 Beecher ..... 342/44
5,227,803 A 7/1993 O'Connor et al.
5,493,499 A 2/1996 Theurer et al.
5,517,475 A 5/1996 Koyama et al.
5,596,203 A 1/1997 Zingarelli et al.
5,602,993 A * 2/1997 Stromberg ..... 707/511
5,677,533 A * 10/1997 Yaktine et al. ..... 246/169 A
5,752,218 A 5/1998 Harrison et al.
5,771,021 A * 6/1998 Veghte et al. ..... 342/51
5,791,063 A 8/1998 Kesler et al.
5,842,283 A 12/1998 Yatsu et al.
5,893,043 A 4/1999 Moehlenbrink et al.
5,956,664 A * 9/1999 Bryan ..... 702/184
5,961,571 A 10/1999 Gorr et al.
6,128,558 A 10/2000 Kernwein
6,189,838 B1 2/2001 Nicolette et al.
6,266,442 B1 * 7/2001 Laumeyer et al. ..... 382/190
6,356,802 B1 * 3/2002 Takehara et al. ..... 700/215

* cited by examiner

*Primary Examiner*—S. Joseph Morano
*Assistant Examiner*—Lars A Olson
(74) *Attorney, Agent, or Firm*—Carl A. Rowold; Armstrong Teasdale LLP

(57) ABSTRACT

A method for identifying and determining the position of rolling stock within a railyard using a system that includes an AEI reader, a plurality of elevated electronic imaging devices and a tracking computer. The rolling stock includes a plurality of railcars and a plurality of locomotives. The method includes recording an identification pattern for each piece of rolling stock as each piece enters the railyard, compiling tracking data of the rolling stock as the rolling stock moves within the railyard using the respective identification patterns, and mapping the position of each piece of rolling stock as the rolling stock moves within the railyard.

10 Claims, 4 Drawing Sheets

YARD TRACKING SYSTEM

CROSS REFERENCE TO RELATED APPLICATION

This application claims the benefit of U.S. Provisional Application No. 60/258,520, filed Dec. 28, 2000.

BACKGROUND OF THE INVENTION

This invention relates generally to railyards, and more particularly to determining the location of rolling stock, including railcars and locomotives, within a railyard.

Railyards are the hubs of railroad transportation systems. Therefore, railyards perform many services, for example, freight origination, interchange and termination, locomotive storage and maintenance, assembly and inspection of new trains, servicing of trains running through the facility, inspection and maintenance of railcars, and railcar storage. The various services in a railyard compete for resources such as personnel, equipment, and space in various facilities so that managing the entire railyard efficiently is a complex operation.

The railroads in general recognize that yard management tasks would benefit from the use of management tools based on optimization principles. Such tools use a current yard status and a list of tasks to be accomplished to determine an optimum order in which to accomplish these tasks.

However, any management system relies on credible and timely data concerning the present state of the system under management. In most railyards, the current data entry technology is a mixture of manual and automated methods. For example, automated equipment identification (AEI) readers and AEI computers determine the location of rolling stock at points in the sequence of operations, but in general, this information limits knowledge of rolling stock whereabouts to at most the moment at which the rolling stock arrived, the moment at which the rolling stock passes the AEI reader, and the moment at which the rolling stock departs.

BRIEF DESCRIPTION OF THE INVENTION

In one aspect, a method is provided for identifying and determining the position of rolling stock within a railyard using a system that includes an AEI reader, a plurality of elevated electronic imaging devices and a tracking computer. The rolling stock includes a plurality of railcars and a plurality of locomotives. The method includes recording an identification pattern for each piece of rolling stock as each piece enters the railyard, compiling tracking data of the rolling stock as the rolling stock moves within the railyard using the respective identification patterns, and mapping the position of each piece of rolling stock as the rolling stock moves within the railyard.

In another aspect, a system is provided for identifying and determining the position of rolling stock within a railyard. The system includes an AEI reader, an AEI computer, a plurality of elevated electronic imaging devices, and a tracking computer. The rolling stock includes a plurality of railcars and a plurality of locomotives. The system is configured to record an identifier unique to each piece of rolling stock as each piece of rolling stock enters the railyard, compile tracking data of the rolling stock as the rolling stock moves within the railyard using respective identification patterns, and map the position of each piece of rolling stock as the rolling stock moves within the railyard.

In another aspect, a system is provided for identifying and determining the position of movable components within a yard. The system includes an AEI reader, an AEI computer, a plurality of elevated electronic imaging devices, and a tracking computer. The system is configured to record an identifier unique to an AEI tag attached to a respective movable component as each tagged component enters the yard, compile tracking data of the tagged movable components as the tagged components move within the yard using identification patterns, and map the position of each tagged movable component as the tagged component moves within the yard.

In a further aspect, a method is provided for tracking rolling stock within a railyard using a system that includes an AEI reader, a plurality of elevated electronic imaging devices, and a tracking computer. The rolling stock includes a plurality of railcars and a plurality of locomotives. The method includes uniquely identifying each piece of rolling stock as it enters the railyard using AEI readers at all yard entrances and exits, correlating each piece of the identified rolling stock with an image using an elevated electronic imaging device, tracking incremental movements of the images using tracking algorithms in the tracking computer while maintaining the correlation with the unique rolling stock identifier, and performing handoff from one elevated electronic imaging device to another electronic imaging device through position and shape correlation.

DETAILED DESCRIPTION OF THE INVENTION

Figure 1:
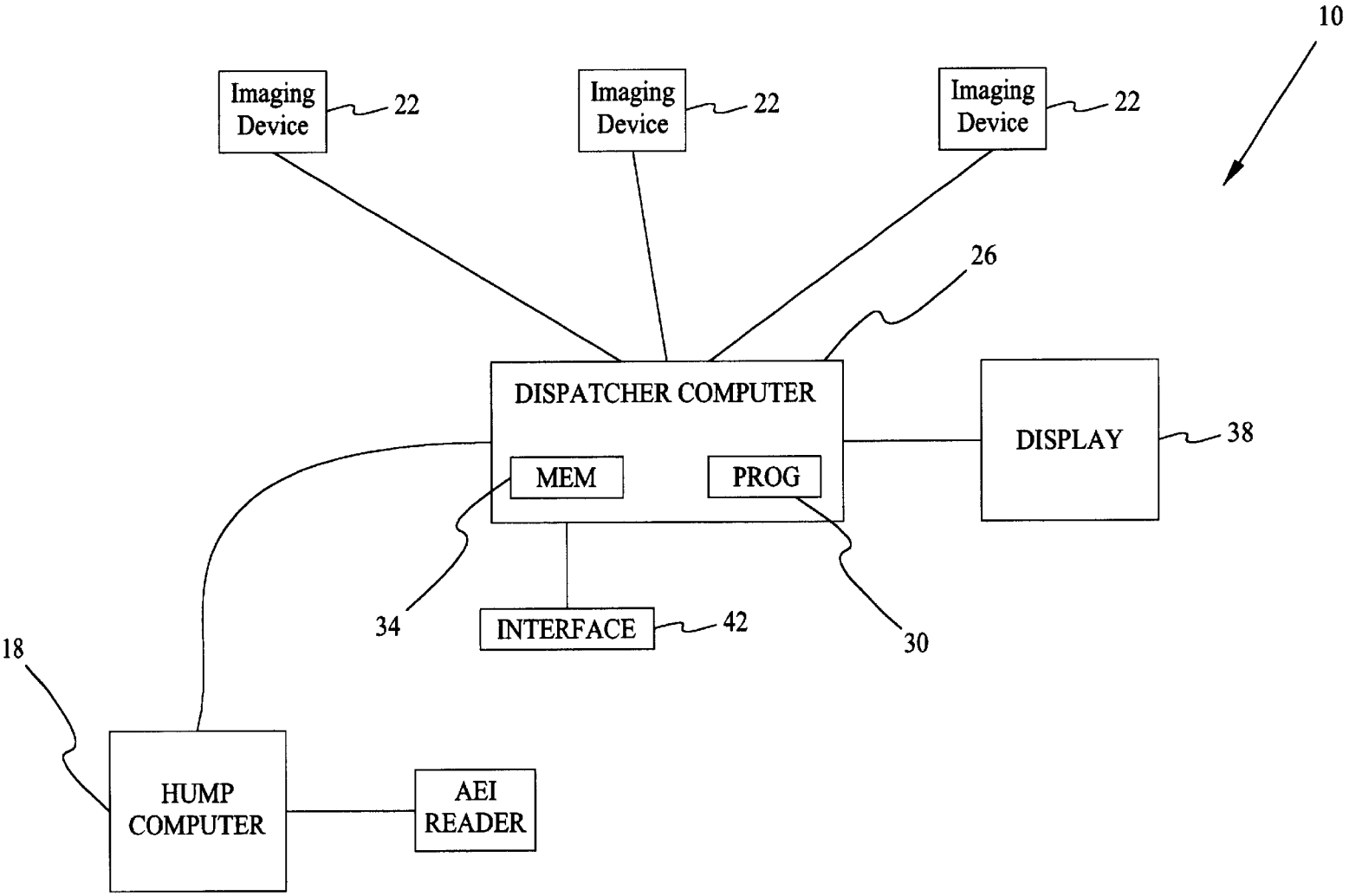
FIG. 1 is a schematic of a system for tracking the position of rolling stock within a railyard in accordance with the present invention.

FIG. 1 is a schematic of a system 10 for determining the position of rolling stock within a railyard in accordance with one embodiment of the present invention. System 10 includes an automated equipment identification (AEI) reader 14, a AEI computer 18, a plurality of elevated electronic imaging device 22, and a tracking computer 26. Tracking computer 26 includes a processor 30 suitable to execute all functions of tracking computer 26 and an electronic storage device 34 for storing programs, information and data. Additionally, tracking computer 26 is connected to a display 38 for viewing information, data and graphical representations of the railyard, and a dispatcher interface 42 that allows a dispatcher to input information and data to tracking computer 26, for example a keyboard or a mouse.

Each piece of rolling stock in a train consist, for example each railcar and each locomotive, has an Automated Equipment Identification tag (not shown) attached. The AEI tag includes information that uniquely identifies the piece of rolling stock to which it is attached. As a train consist enters a railyard each piece of rolling stock passes AEI reader 14. As each piece of rolling stock passes AEI reader 14, reader 14 collects the identification information from each AEI tag, thereby identifying each piece of rolling stock that passes reader 14. In an exemplary embodiment, the AEI tag contains coded information and AEI reader is a backscatter transponder. However, the AEI tag and AEI reader 14 are not limited to utilizing backscatter technology and any other information recording and tracking equipment is applicable, for example, a tag containing printed information and a reader utilizing optical character recognition technology.

Reader 14 is connected to an AEI computer 18 and after reading the AEI tag for a piece of rolling stock, reader 14 communicates the identification information to AEI computer 18. AEI computer 18 processes the identification information creating AEI data and communicates the AEI data to tracking computer 26 located at a remote site. In an exemplary embodiment, system 10 positions one elevated electronic imaging device 22 at an entrance to the railyard. Such electronic imaging devices are well known in the art. Other embodiments are possible where more than one elevated electronic imaging device 22 is positioned at the railyard entrance. In the exemplary embodiment, as each piece of rolling stock passes AEI reader 14 and AEI reader 14 records identification information from the AEI tag, entrance imaging device 22 simultaneously captures a video image of the respective piece of rolling stock. Entrance imaging device 22 is connected to tracking computer 26, as are all other elevated electronic imaging device 22. After a master video image is captured the image is communicated to tracking computer 26. Tracking computer 26 correlates, links, and/or pairs, the AEI data with the related video image for each piece of rolling stock. The video image, AEI data, and correlations are then stored in electronic memory device 34.

Figure 2:
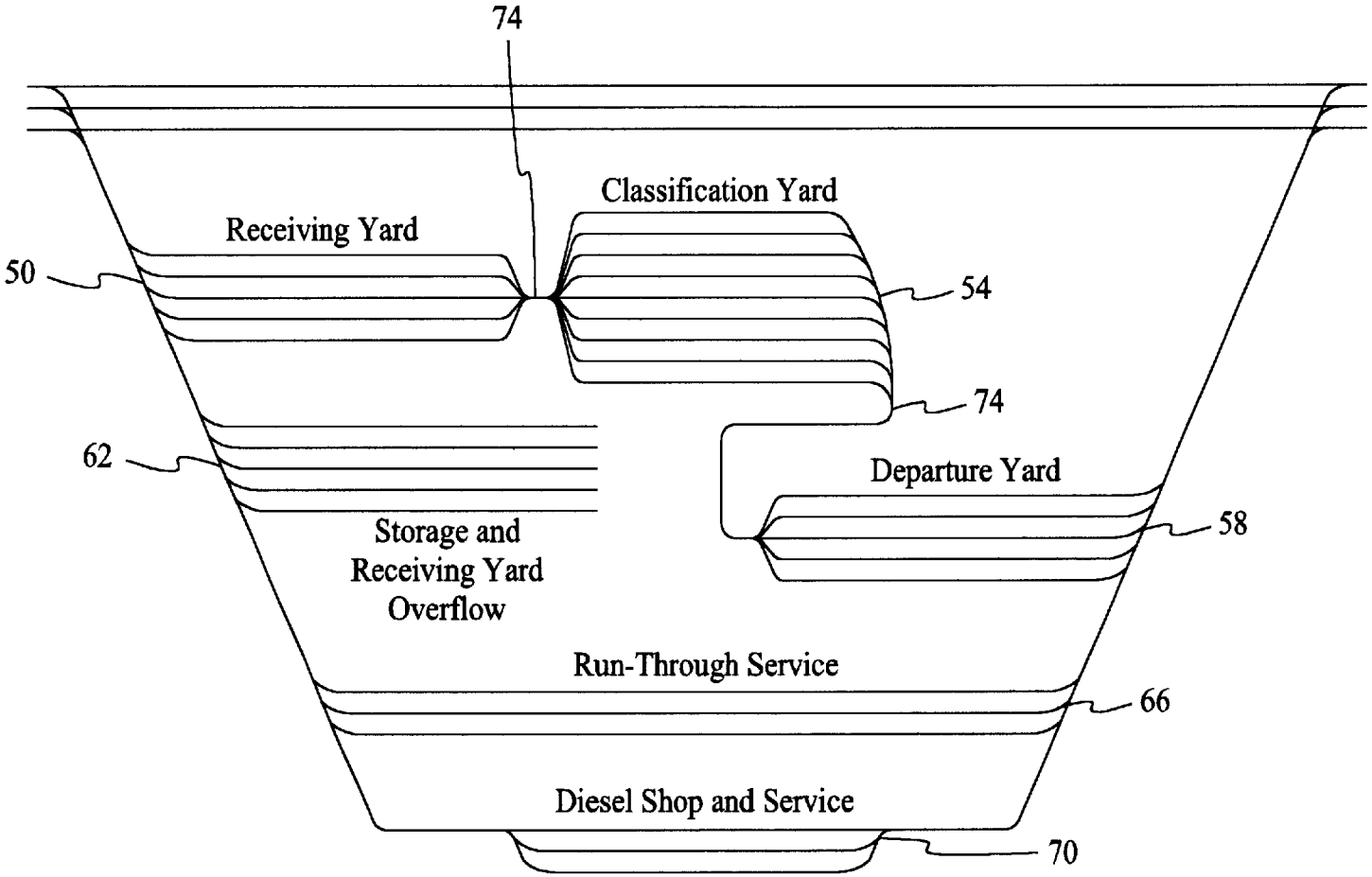
FIG. 2 is a diagram of a railyard for illustrating the various areas of the railyard that rolling stock pass through during railyard processing and are tracked using the system shown in FIG. 1.

FIG. 2 is a diagram of a railyard layout for illustrating particular railyard activities for which the yard tracking system shown in FIG. 1 is utilized. A railyard includes various sets of tracks dedicated to specific uses and functions. For example, an incoming train arrives in a receiving yard 50 and is assigned a specific receiving track. Then at some later time, a switch engine enters the track and moves the railcars into a classification area, or bowl, 54. The tracks in classification yard 54 are likewise assigned to hold specific blocks of railcars being assembled for outbound trains. When a block of railcars is completed it is assigned to a specific track in a departure yard 58 reserved for assembling a specific outgoing train. When all the blocks of railcars for the departing train are assembled, one or more locomotives from a locomotive storage and receiving overflow yard 62 will be moved and coupled to the assembled railcars. A railyard also includes a service run through area 66 for servicing railcars, and a diesel shop and service area 70 to service and repair locomotives. The organization of yards normally includes a number of throats, or bottlenecks 74, through which all cars involved in the train building process (TBP) must pass. Throats 74 limit the amount of parallel processing possible in a yard, and limit the rate at which the sequence of train building tasks may occur.

Additional elevated electronic imaging devices 22 (shown in FIG. 1) are strategically located throughout the railyard. For example, one imaging device 22 is positioned in receiving yard 50, another electronic imaging device 22 is positioned in classification yard 54. Further imaging devices 22 are positioned in departure yard 58, service run-through area 66, diesel shop and service area 70 and bottlenecks 74. Railyard elevated imaging devices 22 capture secondary video images of rolling stock as the rolling stock is processed through the TBP.

Referring to FIG. 1, each railyard electronic imaging device 22 has a designated viewing area and captures secondary video images of the pieces of rolling stock within that viewing area at a specified duty cycle. Each secondary image is communicated to tracking computer 26, along with an identifier identifying which railyard-imaging device 22 communicated the secondary image. Processor 30 then interprets each image by executing a pattern recognition and tracking algorithm stored in electronic memory device 34, thereby identifying the piece of rolling stock related to each secondary video image and the location within the railyard of the piece of rolling stock. The pattern recognition algorithm defines the shape of the piece of rolling stock as viewed by electronic imaging device 22 as it passes by AEI reader 14. This process may be augmented by using the AEI data to access a known railcar and locomotive database such as the Umler database and correlating the stored shape of the railcar or locomotive with that scanned by imaging device 22. As the piece of rolling stock progresses through the yard, an incremental tracking algorithm initially based on this stored shape is used whereby each small movement of said rolling stock is used to register the revised shape of the particular piece of rolling stock. In this manner, changes in orientation and illumination are continuously compensated. Multiple imaging devices 22 are arranged such that a region of overlapping coverage exists between each adjacent pair. Tracking computer 26 stores the physical locations associated with the picture elements within the field of view of each imaging device 22 such that handoff may be performed for a given piece or rolling stock based on spatial and pattern correlation between adjacent pairs of imaging devices 22.

After each piece of rolling stock is identified for each secondary video image, processor 30 executes a mapping program that resides on storage device 34. The mapping program computes coordinates for each identified piece of rolling stock, and plots the coordinates on a graphical representation of the railyard displayed as an electronic map viewed on display 38. The graphical representation identifies each piece of rolling stock by the identification number of each piece. Since secondary video images are captured and rolling stock identified repetitiously based on the duty cycle, a dispatcher views an up to date graphical representation depicting the location of each piece of rolling stock within the railyard during the train building process. In an alternate embodiment, the results of the tracking process are displayed on a computer aided dispatch (CAD) system (not shown).

In another alternate embodiment, system 10 includes a railyard management information system (MIS) (not shown) that includes auxiliary data and information relevant to the TBP, such as train identifiers and destination identifiers. The auxiliary data supplied by the MIS is used to cross reference rolling stock with the train and/or destination identifiers. Utilizing the train and destination identifiers, system 10 displays rolling stock with the same train and/or destination identifiers as trains.

Figure 3:
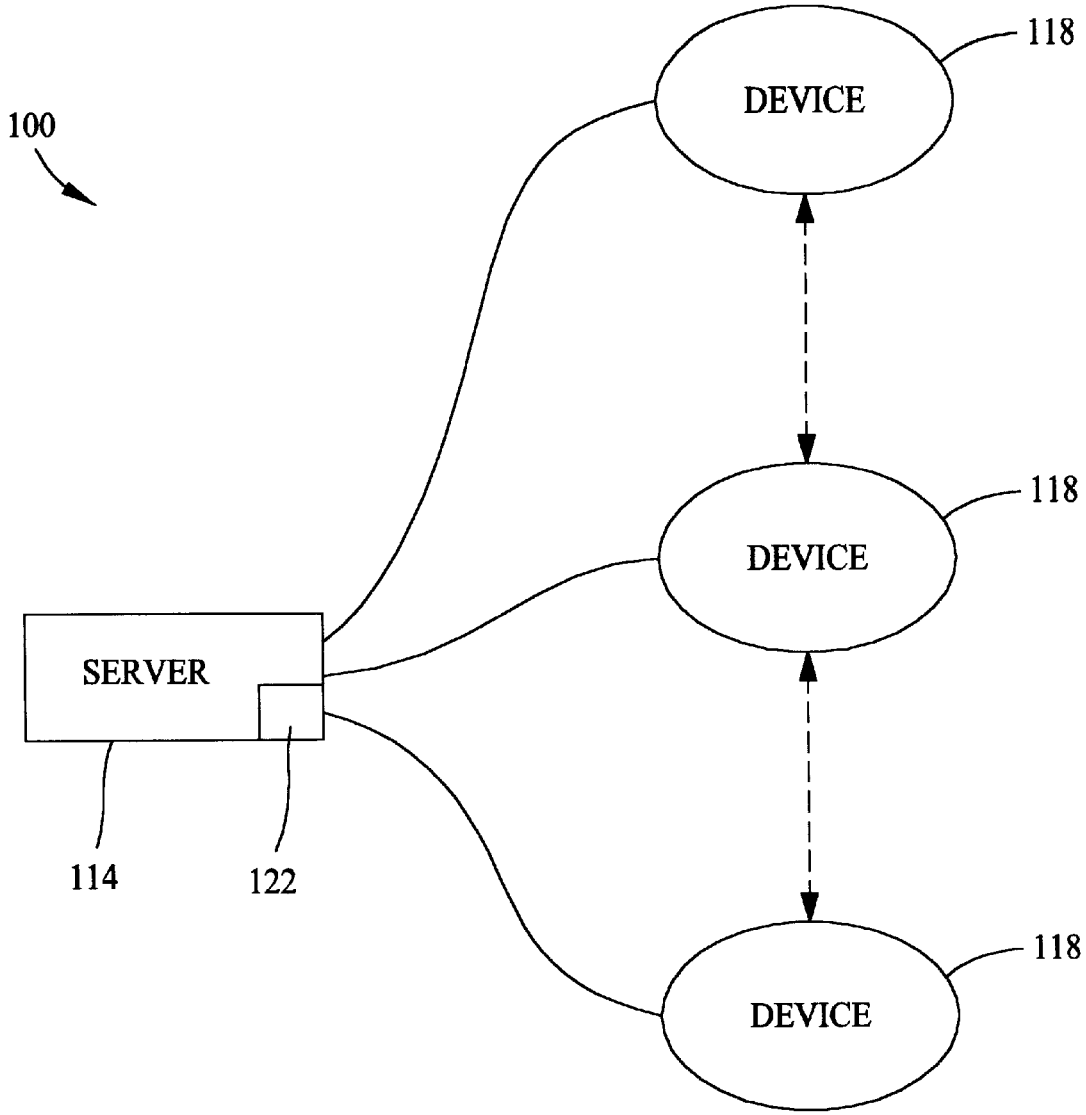
FIG. 3 is a schematic of a server system for tracking rolling stock in a railyard, used in conjunction with the system shown in FIG. 1.

FIG. 3 is a schematic of a server system 100 for tracking rolling stock in a railyard, used in conjunction with system 10 (shown in FIG. 1). In an alternate embodiment, tracking computer 26 (shown in FIG. 1) is part of a computer network accessible using the Internet. Server system 100 is an automated system that includes a server 114 and a plurality of client systems 118 connected to server 114. In one embodiment, client systems 118 include a computer (not shown), such as tracking computer 26 (shown in FIG. 1), including a web server, a central processing unit (CPU), a random access memory (RAM), an output device, for example a monitor, a mass storage device, and an input device, for example a keyboard or a mouse. In an alternative embodiment, client systems 118 are servers for a network of customer devices.

Server 114 is accessible to client systems 118 via the Internet. Client systems 118 are interconnected to server 114 through many interfaces including dial-in-connections, cable modems, special high-speed ISDN lines, and networks, such as local area networks (LANs) or wide area networks (WANs). In one embodiment, client systems 118 include any client system capable of interconnecting to the Internet including a web-based phone or other web-based movable equipment. Server 114 is also connected to mass storage device 122. Mass storage device 122 is accessible by potential users through client systems 118.

Figure 4:
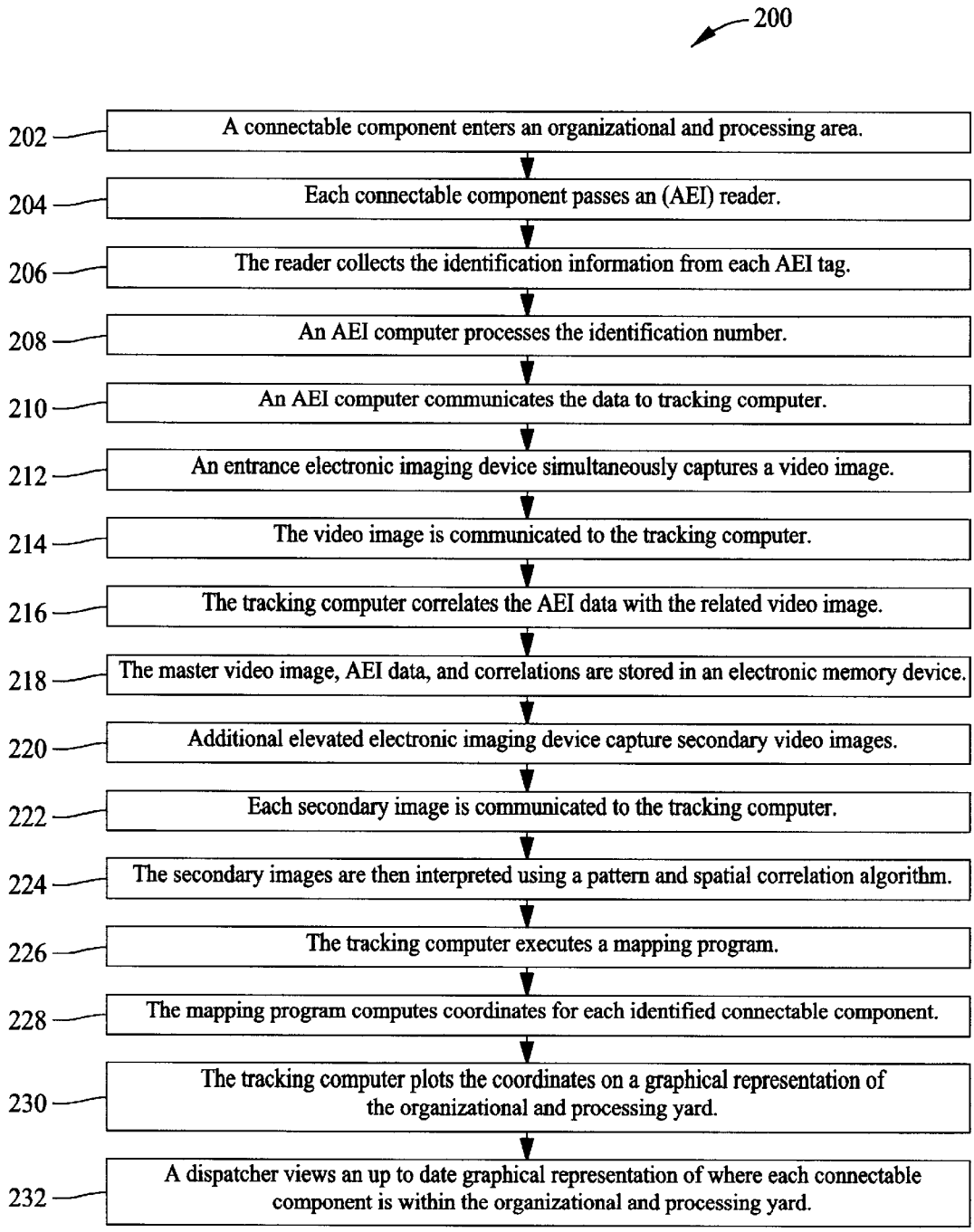
FIG. 4 is a flow chart of a system for tracking the position of movable components within an organizational and processing area in accordance with the present invention.

FIG. 4 is a flow chart 200 of a system for tracking the position of movable components within an organizational and processing area in accordance with one embodiment of the present invention. In another exemplary embodiment, tracking system 10 (shown in FIG. 1) and server system 100 (shown in FIG. 3) are used to track the position of movable components other than rolling stock within a railyard. For example system 10 and system 100 are used to track the position of trailer cars and the over-the-road trucks used to transport the trailer cars within a truck yard.

Each movable component has an AEI tag containing information that uniquely identifies the movable component to which it is attached. As a movable component enters 202 an organizational and processing area each movable component passes 204 an AEI reader. As each movable component passes the AEI reader, the reader collects 206 the identification information from each AEI tag, thereby collecting an identifier unique to each movable component. The reader is connected to an AEI computer that processes 208 the identification information creating AEI data and communicates 210 the data to a tracking computer located at a remote site. As each movable component passes the AEI reader, an entrance electronic imaging device simultaneously captures 212 a master video image of the respective movable component. After a master video image is captured it is communicated 214 to the tracking computer. The tracking computer correlates 216 the AEI data with the related master video image for each movable component. The master video image, AEI data, and correlations are then stored 218 in the tracking computer.

Additional elevated electronic imaging devices are strategically located throughout the organizational and processing yard. At a specified duty cycle, the additional elevated electronic imaging devices capture 220 secondary video images of the movable components as the components are processed through the organizational and processing yard. Each secondary image is communicated 222 to the tracking computer, along with an identifier identifying which imaging device communicated the secondary image. The images are then interpreted 224 using a pattern recognition and tracking algorithm stored in the tracking computer, thereby identifying the movable component related to each secondary video image. Therefore, secondary video images are captured, transferred to the tracking computer, and interpreted repetitiously based on the selected duty cycle.

After each movable component is identified for each secondary video image, the tracking computer executes 226 a mapping program. The mapping program computes 228 coordinates for each identified movable component, and plots 230 the coordinates on a graphical representation of the organizational and processing yard viewed on a display connected to the tracking computer. Since secondary video images are captured and each movable component identified repetitiously based on the duty cycle, a dispatcher views 232 an up to date graphical representation of the location of each movable component within the organizational and processing yard during the processing of the movable components.

While the invention has been described in terms of various specific embodiments, those skilled in the art will recognize that the invention can be practiced with modification within the spirit and scope of the claims.

What is claimed is:

1. A method for identifying and determining the position of rolling stock within a railyard using a system that includes a video imaging device adjacent an entrance to the railyard, constituting an entry video imaging device, for capturing images in electronic data of the external appearance of each piece of rolling stock generally at the time of entry of the piece of rolling stock into the railyard, a plurality of video imaging devices at spaced locations in the railyard, constituting railyard-wide video imaging devices, for capturing images in electronic data of the external appearance of the pieces of rolling stock in the railyard, a database with data representative of a map of the railyard and a tracking computer in communication with the database and the entry and railyard-wide video imaging devices, the rolling stock includes a plurality of railcars and a plurality of locomotives, said method comprising:

recording a video image of the shape of each piece of rolling stock generally at the time each piece enters the railyard;

transmitting imaging data from the entry video imaging device to the tracking computer;

recording video images of the shape of the pieces of rolling stock located in the railyard via the railyard-wide video imaging devices at timed intervals;

transmitting imaging data from the railyard-wide video imaging devices to the tracking computer;

processing the imaging data from the entry and railyard-wide video imaging devices in the tracking computer to associate the image of each piece of rolling stock as said piece of rolling stock enters the railyard with subsequent images of the said piece of rolling stock as it moves through the railyard; and determining the position of each piece of rolling stock in the railyard as the rolling stock moves within the railyard.

2. A method in accordance with claim 1 wherein the system includes an AEI reader, and an AEI tag is coupled to each piece of rolling stock, said method further comprises:

positioning the plurality of video imaging devices such that rolling stock may be viewed with the plurality of video imaging devices as the rolling stock enters the railyard; and collecting AEI data from each AEI tag using the AEI reader as each piece of rolling stock enters the railyard.

3. A method in accordance with claim 2 further comprising:

processing AEI data for each piece of rolling stock using an AEI computer; and capturing a video image of each piece of rolling stock as the AEI data from each AEI tag is collected.

4. A method in accordance with claim 3 wherein the tracking computer includes a processor and an electronic storage device, the tracking computer connected to a display and a dispatcher interface, said method further comprising:

transmitting each video image from the plurality of video imaging devices to the tracking computer; and communicating the processed AEI data for each piece of rolling stock from the AEI computer to the tracking computer.

5. A method in accordance with claim 4 further comprising:

correlating the AEI data for each piece of rolling stock with the video image that was captured using the tracking computer; and storing the master video image, the AEI data, and the correlation data for each piece of rolling stock in the electronic storage device.

6. A method in accordance with claim 1 wherein compiling tracking data comprises:

positioning video imaging devices at a plurality of selected locations within the railyard;

capturing a video image of each piece of rolling stock throughout the railyard using the plurality of video imaging devices, each of the plurality of video imaging devices capturing the video images of the rolling stock; and repeating the capturing of video images at a specific duty cycle.

7. A method in accordance with claim 6 wherein a pattern recognition and tracking algorithm is stored on the electronic storage device and executable by the processor, said method further comprising:

communicating video images from the plurality of video imaging devices to the tracking computer each time a video image is captured; and interpreting the secondary video images with the pattern recognition and tracking algorithm.

8. A method in accordance with claim 7 further comprising:

correlating the interpreted video images to video images stored within the computer; and identifying each piece of rolling stock using the correlations.

9. A method in accordance with claim 8 further comprising:

determining the location of each piece of identified rolling stock utilizing the recognition and tracking algorithm each time a piece of rolling stock is identified; and storing the location of each piece of rolling stock in the electronic storage device each time the location is determined.

10. A method in accordance with claim 1 wherein a mapping program is stored on the electronic storage device and executed by the processor, mapping the position of the rolling stock comprises:

computing mapping coordinates of each piece of rolling stock using the mapping program each time the location is determined; and graphically displaying the location of each piece of rolling stock on the display each time the mapping coordinates are computed.

* * * * *